US007090437B2

(12) United States Patent
Pinkleton

(10) Patent No.: US 7,090,437 B2
(45) Date of Patent: Aug. 15, 2006

(54) MODULAR HELICAL ANCHOR

(76) Inventor: Michael A. Pinkleton, 35850 Industrial Rd., Livonia, MI (US) 48150

( * ) Notice: Subject to any disclaimer, the term of this patent is extended or adjusted under 35 U.S.C. 154(b) by 0 days.

(21) Appl. No.: 10/637,021

(22) Filed: Aug. 7, 2003

(65) Prior Publication Data

US 2004/0028481 A1 Feb. 12, 2004

Related U.S. Application Data

(60) Provisional application No. 60/401,596, filed on Aug. 7, 2002.

(51) Int. Cl.
*E02D 5/74* (2006.01)

(52) U.S. Cl. ..... 405/244; 52/157

(58) Field of Classification Search ..... 405/231, 405/232, 241, 244, 250, 251, 259.1; 52/155, 52/157, 153, 165; 248/156, 530, 545; 175/323
See application file for complete search history.

(56) References Cited

U.S. PATENT DOCUMENTS

| | | | | | |
|---|---|---|---|---|---|
| 2,260,811 | A | * | 10/1941 | Kozak | 403/19 |
| 2,729,067 | A | * | 1/1956 | Patterson | 405/236 |
| 3,178,210 | A | * | 4/1965 | Dickinson | 403/292 |
| 3,272,317 | A | * | 9/1966 | Kelly | 198/666 |
| 4,389,034 | A | * | 6/1983 | Suttles | 248/49 |
| 4,691,818 | A | * | 9/1987 | Weber | 198/666 |
| 4,792,088 | A | * | 12/1988 | Bonnell | 232/17 |
| 5,011,336 | A | | 4/1991 | Hamilton et al. | |
| 5,120,163 | A | | 6/1992 | Holdeman et al. | |
| 5,139,368 | A | | 8/1992 | Hamilton et al. | |
| 5,171,107 | A | | 12/1992 | Hamilton et al. | |
| 5,213,448 | A | | 5/1993 | Seider et al. | |
| 5,575,593 | A | * | 11/1996 | Raaf | 405/237 |
| 5,904,447 | A | * | 5/1999 | Sutton et al. | 405/263 |
| 5,919,005 | A | | 7/1999 | Rupiper | |
| 6,352,391 | B1 | | 3/2002 | Jones | |
| 6,615,554 | B1 | * | 9/2003 | Rupiper | 52/157 |
| 6,814,525 | B1 | * | 11/2004 | Whitsett | 405/233 |

OTHER PUBLICATIONS

A.B. Chance Company and Hubbell/Chance, "Tieback Anchors", Bulletin 31-9601, Apr. 1998, pp. 1-8.
A.B. Chance Company and Hubbell Power Systems, Inc. "Helical Pier Foundation Systems", Bulletin 01-9501, Jun. 1999, pp. 1-8.
A.B. Chance Company and Hubbell Power Systems, Inc., "Helical Peir Foundation Systems Technical Manual", Bulletin 01-9601, Jan. 2000, pp. 1-12.
Seider, Gary L., Hubbell Power Systems, Inc., "Versatile Steel Screw Anchors", Bulletin 01-0001, 2000, pp. 1-5.

* cited by examiner

*Primary Examiner*—Sunil Singh
(74) *Attorney, Agent, or Firm*—Butzel Long

(57) ABSTRACT

A modular helical anchor apparatus includes at least two shaft sections connected by an anchor section. An end of each of the shaft sections is releasably connected to opposite ends of the anchor sections by fasteners. The anchor section includes a helical member.

14 Claims, 2 Drawing Sheets

MODULAR HELICAL ANCHOR

CROSS-REFERENCE TO RELATED APPLICATION

This application claims the benefit of U.S. provisional patent application Ser. No. 60/401,596 filed Aug. 7, 2002.

BACKGROUND OF THE INVENTION

The present invention relates generally to a screw anchor apparatus for use in underpinning and tiebacks and, in particular, to a modular helical anchor.

Helical anchors are well known. Helical anchors are utilized in the geotechnical industry to anchor building foundations in unstable soil and to stabilize and/or repair the integrity of existing foundations and the like. A typical helical anchor is part of an assembly that consists of at least one elongated shaft member having at least one helical plate member attached thereto and extending therearound. The helical plate member is fixedly attached to the shaft member and the assembly is mounted in the ground for securing to a foundation or the like. Typically, the helical plate member is placed in the ground and the helical anchor assembly is rotated about the longitudinal axis of the shaft member, which enables the helical plate member to engage with the ground material, drawing the entire assembly into the ground to form, typically with a plurality of other anchor assemblies, a firm anchor point for the foundation. The anchor assemblies can be utilized under compression, known in the art as underpinning, wherein the anchor assembly supports a body by absorbing a compression load between opposed ends, one of which is attached to the ground and the other of which is attached to the body. The anchor assemblies can also be utilized under tension, known in the art as a tieback, wherein the anchor assembly retains the body to the foundation by applying a tension load to the opposed ends thereof.

It is common for the helical anchor assembly to vary in length, depending on the different requirements of the particular installation. Typically, the length of the helical anchor is varied by attaching a plurality of shaft members end to end, with each of the shaft members having at least one helical member attached thereto, to form an elongated anchor assembly. The shaft members are typically required to be attached by welding at the job site when the helical anchor assembly is installed, which is disadvantageously time-consuming and expensive. In addition, the helical anchor assemblies are often installed in tight quarters, which makes welding the shaft members particularly difficult.

It is desirable, therefore, to provide a helical anchor assembly that is modular in design for modifying the length of the assembly for the requirements of each installation. It is also desirable to provide a helical anchor that may be assembled, utilized, and installed in tight quarters.

SUMMARY OF THE INVENTION

The present invention concerns a modular helical anchor apparatus for use in underpinning and tiebacks. The modular helical anchor assembly includes: at least two shaft sections; at least one anchor section having a helical plate attached thereto; and fastening means releasably attaching said shaft sections to opposite ends of said at least one anchor section.

The modular helical anchor in accordance with the present invention is advantageously suitable for use as an underpinning (under compression) or as a tieback (under tension). The shaft sections and anchor sections are modular and, therefore, may be prefabricated and used as a kit together with a plurality of other shaft sections and anchor sections to tailor the helical anchor assembly to the requirements of the particular installation, allowing field personnel at the construction site to select the size and quantity of helices without field welding.

The present invention advantageously provides a modular helical anchor assembly that is modifiable in length by fastening shaft portions with the anchor portions without requiring the portions to be welded together. Furthermore, the fasteners of the present invention allow the anchor assembly to be assembled and mounted in tight quarters.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
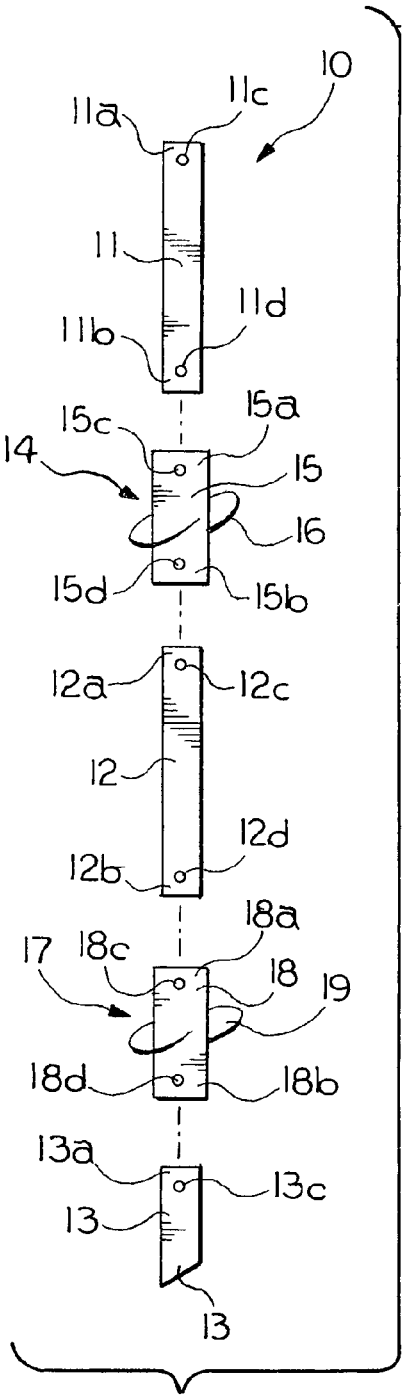
FIG. 1 is an exploded elevation view of a modular helical anchor apparatus in accordance with the present invention.
Figure 2:
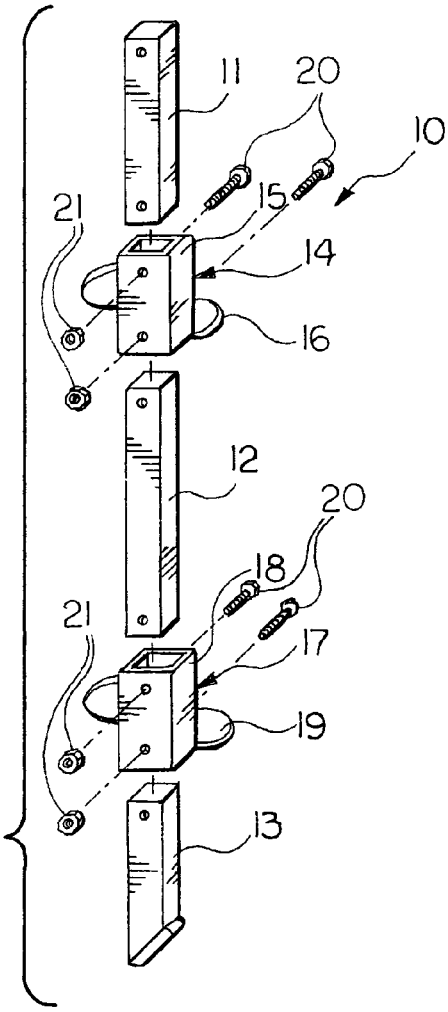
FIG. 2 is an exploded perspective view of the modular helical anchor apparatus shown in FIG. 1.

A modular helical anchor apparatus 10 is shown in FIGS. 1 and 2 for use in underpinning and tieback installations. A first or upper shaft section 11 can be formed of a square cross section metal bar stock of any suitable length having an upper end 11*a* and a lower end 11*b*. A second or middle shaft section 12 can be constructed the same as the first shaft section 11 having an upper end 12*a* and a lower end 12*b*. A third or lower shaft section 13 can be formed of the same material with the same cross section as the sections 11 and 12 having an upper end 13*a* and a lower end 13*b*. A first anchor section 14 is formed of a square cross section tube 15 having an open upper end 15*a* sized to receive the lower end lib and an open lower end 15*b* sized to receive the upper end 12*a*. The tube 15 has a helical plate 16 attached thereto and extending thereabout. Preferably, the helical plate 16 is welded to the tube 15. A second anchor section 17 is formed of a square cross section tube 18 having an open upper end 18*a* sized to receive the lower end 12*b* and an open lower end 18*b* sized to receive the upper end 13*a*. The tube 18 has a helical plate 19 attached thereto and extending thereabout. Preferably, the helical plate 19 is welded to the tube 18. The lower end 13*b* is pointed or tapered to assist in installing the anchor apparatus 10 in the ground.

Figure 1A:
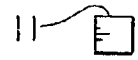
FIGS. 1A and 1B are end views of the first shaft section and the tube of the first anchor section shown in FIG. 1.
Figure 1B:
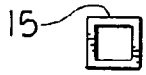
Figure 1C:
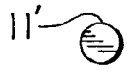
FIGS. 1C and 1D are end views of alternate embodiments of the first shaft section and the tube of the first anchor section shown in FIG. 1.
Figure 1D:
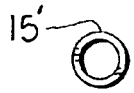

FIGS. 1A and 1B are end views of the first shaft section 11 and the tube 15 of the first anchor section 14 respectively showing the square cross section. FIGS. 1C and 1D are end views of alternate embodiment first shaft section 11' and tube 15' of the first anchor section 14 respectively showing a round or circular cross section.

The length, cross section, and number of the sections 11 and 12 and the diameter of each of the helical plates 16 and 19 can be selected to correspond to the requirements of the installation. Thus, the modular design of the helical anchor 10 according to the present invention permits an anchor system to be custom built to the installation requirements. The upper end 13*a* is provided with a through aperture 13*c* that can be aligned with a through aperture 18*d* formed in the lower end 18*b* when the third shaft section 13 is inserted into the second anchor section 17. A suitable fastener such as a bolt 20 is inserted through the apertures 18*d* and 13*c* and threadably engaged with a nut 21. Alternatively, another suitable type of fastener, such as a rivet or the like (not shown) is used to fasten the shaft sections 11 and 12 to the tube 18. The second shaft section 12 is attached to the second anchor section 17 in a similar manner with the lower end 12*b* being inserted into the upper end 18*a* and a through aperture 12*d* aligned with a through aperture 18*c* to receive the bolt 20 and the nut 21. The first anchor section 14 and the first shaft section 11 are attached in a similar manner. The first shaft section 11 has a through aperture 11*c* formed in the upper end 11*a* to enable additional anchor sections and shaft sections to be attached as desired.

The modular helical anchor apparatus 10 is suitable for use as an underpinning (under compression) or as a tieback (under tension). The modular design permits assembly in the field whereby the diameter and number of the helical plates to be used can be selected on the job without resorting to welding as was required by the prior art anchoring systems. Also the modular helical anchor apparatus 10 is suitable for use in tight quarters (e.g., under a foundation) whereby subsequent shaft sections and anchor sections can be added as the anchor is being screwed into place.

Figure 3:
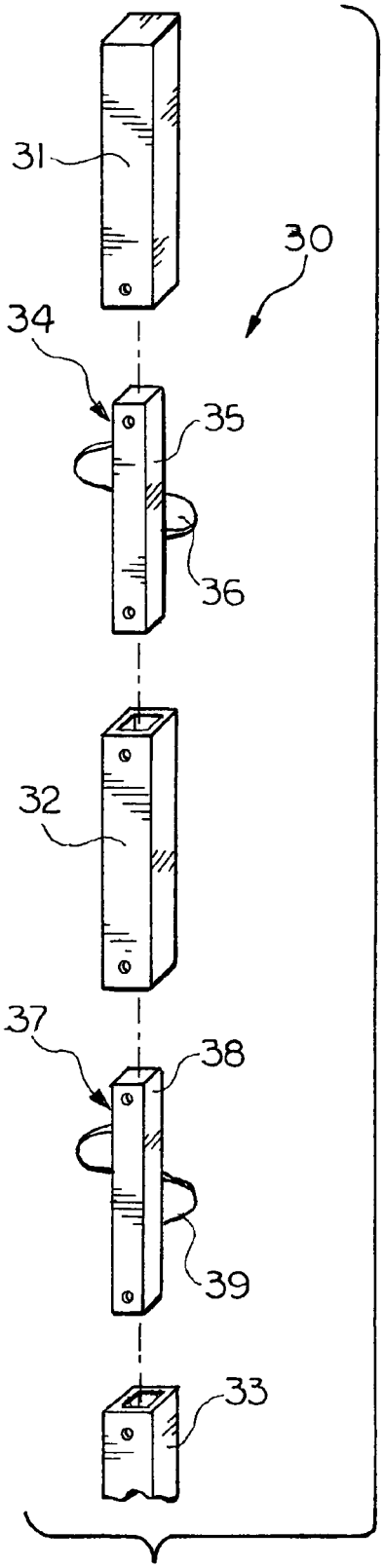
FIG. 3 is an exploded perspective view of an alternate embodiment of the modular helical anchor apparatus according to the present invention.

An alternate embodiment modular helical anchor apparatus 30 is shown in FIG. 3 for use in underpinning and tieback installations. A first or upper shaft section 31 can be formed of a square cross section metal tubular stock of any suitable length as can a second or middle shaft section 32 and a third or lower shaft section 33. A first anchor section 34 is formed of a square cross section bar stock 35 having a helical plate 36 attached thereto and extending thereabout. Preferably, the helical plate 36 is welded to the bar stock 35. A second anchor section 37 is formed of a square cross section bar stock 38 having a helical plate 39 attached thereto and extending thereabout. Preferably, the helical plate 39 is welded to the bar stock 38. The anchor sections 35 and 37 each have ends that are sized to slide into the interiors of the shaft sections 31, 32 and 33 to form the anchor apparatus 30. The shaft sections and the anchor sections are each provided with through apertures, similar to the through apertures 11*c*, 11*d*, 15*a*, 15*b*, 12*c*, 12*d*, 18*c*, 18*d*, 13*a*, and 13*c* shown in FIG. 1, and can be releasably attached using the bolt 20 and nut 21 fasteners shown in FIG. 1.

Figure 4:
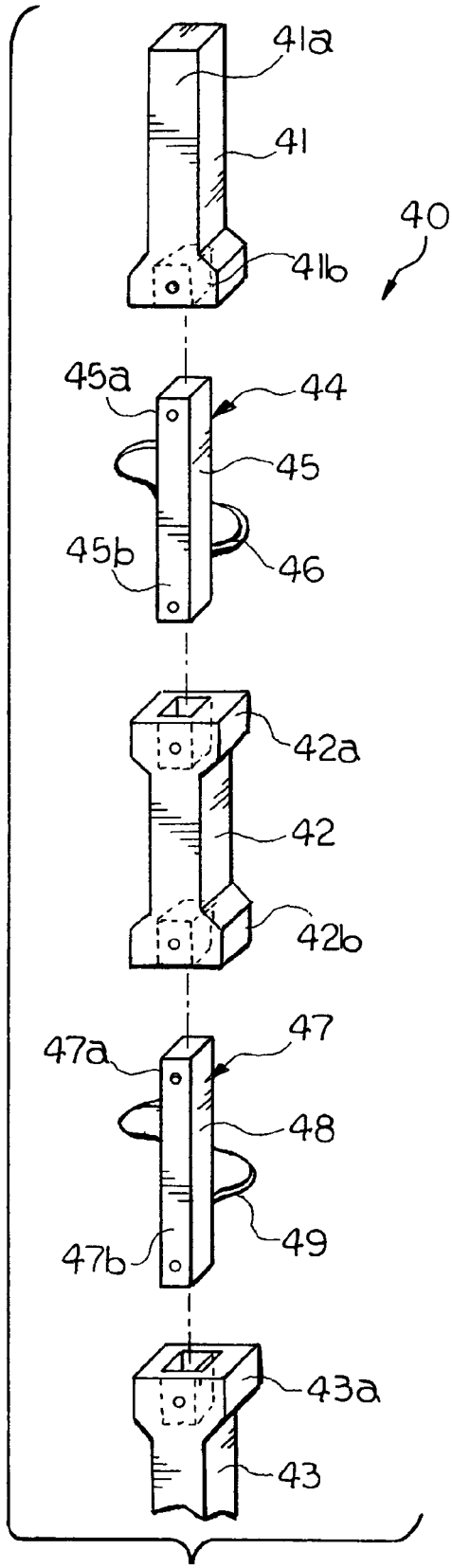
FIG. 4 is an exploded perspective view of another alternate embodiment of the modular helical anchor apparatus according to the present invention.

Another alternate embodiment modular helical anchor apparatus 40 is shown in FIG. 4 for use in underpinning and tieback installations. A first or upper shaft section 41 can be formed of a square cross bar stock of any suitable length as can a second or middle shaft section 42 and a third or lower shaft section 43. A first anchor section 44 is formed of a square cross section bar stock 45 having a helical plate 46 attached thereto and extending thereabout. Preferably, the helical plate 46 is welded to the bar stock 45. A second anchor section 47 is formed of a square cross section bar stock 48 having a helical plate 49 attached thereto and extending thereabout. Preferably, the helical plate 49 is welded to the bar stock 48. A lower end 41*b* of the shaft section 41 is formed with an open end or upset that accepts an upper end 45*a* of the bar stock 45. Similar open ends or upsets are formed on the ends 42*a*, 42*b* and 43*a* to receive the corresponding ends 45*b*, 47*a* and 47*b*. Thus, the anchor sections 45 and 47 are sized to slide into the interiors of the upsets of the shaft sections 41, 42 and 43 to form the anchor apparatus 40. The upsets of the shaft sections and the anchor sections are each provided with through apertures, similar to the through apertures 11*c*, 11*d*, 15*a*, 15*b*, 12*c*, 12*d*, 18*c*, 18*d*, 13*a*, and 13*c* shown in FIG. 1, and can be releasably attached using the bolt 20 and nut 21 fasteners shown in FIG. 1.

Alternatively, the shaft sections 11, 12, 13, 31, 32, 33, 41, 42, and 43 and the anchor sections 15, 17, 35, 37, 45, and 47 are each formed of tube or stock that is circular in cross section or any other type of shape that is advantageous for transmitting torque to the ground for attachment thereto.

The apparatus 10 in accordance with the present invention advantageously provides a helical anchor assembly that is modular, cost-effective, and timesaving for installation of the helical anchor assembly. The present invention advantageously provides a modular helical anchor assembly that is customizable in length by fastening shaft portions with the anchor portions without requiring the portions to be welded. Furthermore, the fasteners of the present invention allow the anchor assembly to be assembled and mounted in tight quarters.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A modular helical anchor assembly for use in a geotechnical support system comprising:

a first anchor section and a second anchor section each having an upper end, a lower end, a helical plate attached thereto between said upper end and said lower end, an upper through aperture adjacent said upper end and a lower through aperture adjacent said lower end;

a shaft section without a helical plate and having an upper end, a lower end, an upper through aperture adjacent said upper end and a lower through aperture formed adjacent said lower end, said first and second anchor sections being formed of one of a tubular stock and a bar stock and said shaft section being formed of another of the tubular stock and the bar stock;

fastening means releasably attaching said first and second anchor sections to said shaft section, said fastener means including a first fastener engaging said lower through aperture of said first anchor section and said upper through aperture of said shaft section and a second fastener engaging said upper through aperture of said second anchor section and said lower through aperture of said shaft section, whereby a portion of said shaft section is exposed between said first and second anchor sections and a spacing between said helical plates can be selected by providing said shaft section with an associated predetermined length; and a lower shaft section without a helical plate, said lower shaft section having an upper end, a pointed lower end and an upper through aperture adjacent said upper end, and wherein said fastening means includes a third fastener engaging said lower through aperture of said second anchor section and said upper through aperture of said lower shaft section.

2. The modular helical anchor assembly according to claim 1 wherein said shaft section and said first and second anchor sections each have a square cross section.

3. The modular helical anchor assembly according to claim 1 wherein said shaft section and said first and second anchor sections have a circular cross section.

4. The modular helical anchor assembly according to claim 1 wherein said first and second anchor sections have a tube portion with said helical plate attached to said tube portion.

5. The modular helical anchor assembly according to claim 4 wherein said helical plate is welded to said tube portion.

6. The modular helical anchor according to claim 1 wherein said first and second fasteners each include a bolt and an associated nut.

7. The modular helical anchor according to claim 1 wherein said first and second anchor sections are tubular for receiving said shaft section and said shaft section is formed of bar stock.

8. The modular helical anchor according to claim 1 wherein said shaft section is tubular for receiving said first and second anchor sections and said first and second anchor sections are formed of bar stock.

9. The modular helical anchor according to claim 1 wherein said ends of said shaft section have upsets for receiving said lower end of said first anchor section and said upper end of said second anchor section.

10. A modular helical anchor assembly for use in a geotechnical support system comprising:

at least a first anchor section and a second anchor section each having an upper end, a lower end, a helical plate attached thereto between said upper end and said lower end, an upper through aperture adjacent said upper end and a lower through aperture adjacent said lower end;

at least a first shaft section and a second shaft section each without a helical plate and having an upper end, a lower end, an upper through aperture adjacent said upper end and a lower through aperture formed adjacent said lower end;

a third shaft section without a helical plate and having an upper end, a tapered lower end and an upper through aperture adjacent said upper end; and fastening means releasably attaching said first and second anchor sections and said first, second and third shaft sections together, said fastener means including a first fastener engaging said lower through aperture of said first shaft section and said upper through aperture of said first anchor section, a second fastener engaging said lower through aperture of said first anchor section and said upper through aperture of said second shaft section, a third fastener engaging said upper through aperture of said second anchor section and said lower through aperture of said second shaft section, and a fourth fastener engaging said lower through aperture of said second anchor section and said upper through aperture of said third shaft section, said first through fourth fasteners each being a bolt and an associated nut, whereby a portion of said second shaft section is exposed between said first and second anchor sections and a spacing between said helical plates can be selected by providing said second shaft section with an associated predetermined length and wherein said first, second and third shaft sections are formed of one of a tubular stock and a bar stock and said first and second anchor sections are formed of another of the tubular stock and the bar stock.

11. The modular helical anchor assembly according to claim 10 wherein said helical plates are welded to said first and second anchor sections.

12. A modular helical anchor assembly for use in a geotechnical support system comprising:

at least a first anchor section and a second anchor section each having an upper end, a lower end, a helical plate attached thereto between said upper end and said lower end, an upper trough aperture adjacent said upper end and a lower through aperture adjacent said lower end;

at least a first shaft section and a second shaft section each without a helical plate and having an upper end, a lower end, an upper through aperture adjacent said upper end and a lower through aperture formed adjacent said lower end;

a third shaft section without a helical plate and having an upper end, a tapered lower end and an upper through aperture adjacent said upper end, said first, second and third shaft sections being formed of one of a tubular stock and a bar stock and said first and second anchor sections being formed of another of the tubular stock and the bar stock; and fastening means releasably attaching said first and second anchor sections and said first, second and third shaft sections together, said fastener means including a first fastener engaging said lower through aperture of said first shaft section and said upper through aperture of said first anchor section, a second fastener engaging said lower through aperture of said first anchor section and said upper trough aperture of said second shaft section, a third fastener engaging said upper through aperture of said second anchor section and said lower trough aperture of said second shaft section, and a fourth fastener engaging said lower through aperture of said second anchor section and said upper through aperture of said third shaft section, whereby a portion of said second shaft section is exposed between said first and second anchor sections and a spacing between said helical plates can be selected by providing said second shaft section with an associated predetermined length.

13. The modular helical anchor assembly according to claim 12 wherein said helical plates are welded to said first and second anchor sections.

14. The modular helical anchor according to claim 12 wherein said that through fourth fasteners are a bolt and an associated nut.

* * * * *